US011035163B2

(12) United States Patent
Braden et al.

(10) Patent No.: US 11,035,163 B2
(45) Date of Patent: Jun. 15, 2021

(54) MOVABLE FRONT PANEL FOR HOME APPLIANCE

(71) Applicants: BSH Home Appliances Corporation, Irvine, CA (US); BSH Hausgeräte GmbH, Munich (DE)

(72) Inventors: Ben Braden, Lafollette, TN (US); Josiah Fronckowiak, LaFollette, TN (US); Ian McIver, Knoxville, TN (US); Shaun Phillips, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 16/591,660

(22) Filed: Oct. 3, 2019

(65) Prior Publication Data

US 2021/0102419 A1 Apr. 8, 2021

(51) Int. Cl.

| | |
|---|---|
| ***E05D 3/18*** | (2006.01) |
| ***E05D 11/10*** | (2006.01) |
| ***E06B 7/28*** | (2006.01) |
| *A47B 96/20* | (2006.01) |

(52) U.S. Cl.

CPC ..... *E05D 11/1007* (2013.01); *E05D 3/18* (2013.01); *E06B 7/28* (2013.01); *A47B 2096/208* (2013.01); *E05Y 2900/30* (2013.01)

(58) Field of Classification Search

CPC ..... E05D 3/18; E05D 11/1007; E06B 7/28; A47B 96/00

USPC ..... 312/276, 321.5, 327, 328, 228

See application file for complete search history.

(56) References Cited

U.S. PATENT DOCUMENTS

| | | | | | |
|---|---|---|---|---|---|
| 1,739,239 | A | * | 12/1929 | Keffer | A24F 19/10 131/241 |
| 3,292,983 | A | * | 12/1966 | Service | A47B 88/48 312/228 |
| 4,756,054 | A | * | 7/1988 | Mitts | E05D 15/46 16/237 |
| 4,840,285 | A | * | 6/1989 | Carr | D06F 58/04 220/4.02 |
| 4,843,680 | A | * | 7/1989 | Cress | E05F 1/1276 16/289 |

(Continued)

FOREIGN PATENT DOCUMENTS

| | | | |
|---|---|---|---|
| EP | 2932880 | A1 | 4/2015 |
| EP | 2881029 | A1 | 6/2015 |
| WO | 2009014489 | A1 | 1/2009 |

*Primary Examiner* — James O Hansen

(74) *Attorney, Agent, or Firm* — Michael E. TSchupp; Andre Pallapies; Brandon G. Braun

(57) ABSTRACT

A domestic appliance may include: a shell; a door coupled to the shell; a treatment compartment defined at least in part by the shell and the door; a panel configured to enclose at least a portion of a cavity below the treatment compartment; an articulation arrangement coupled to the shell and configured to allow the panel to move from a closed and locked vertical position to an unlocked and open non-vertical position whilst being coupled to the shell; and a locking mechanism configured to selectively lock the panel in the vertical position. The articulation arrangement may include a first linear slot and a second slot including a linear portion and a curved portion extending from one end of the linear portion, the first linear slot engaging a first pin and the second slot engaging a second pin.

16 Claims, 10 Drawing Sheets

(56) References Cited

U.S. PATENT DOCUMENTS

| | | | | |
|---|---|---|---|---|
| 8,371,665 | B2 * | 2/2013 | Herrera | A47L 15/4209 312/228 |
| 8,678,526 | B2 * | 3/2014 | Burks | E05D 3/12 312/325 |
| 2006/0043850 | A1 * | 3/2006 | Rapier, III | E05D 3/14 312/321.5 |
| 2011/0101836 | A1 * | 5/2011 | Gamble | A47B 95/002 312/293.3 |
| 2013/0113353 | A1 * | 5/2013 | Carr | A47L 15/4265 312/293.3 |
| 2018/0313019 | A1 | 11/2018 | Bixby et al. | |

* cited by examiner

Closed / Locked Position

Lifted Position

Partially Opened Position

Opened Position

Locked Opened Position

MOVABLE FRONT PANEL FOR HOME APPLIANCE

FIELD OF THE TECHNOLOGY

The present technology relates to home appliances, e.g., ovens, refrigerators, dishwashers, etc., with a kick plate. The present technology further relates to a movable front panel that may be used to secure the kick plate at a base of the home appliance.

BACKGROUND

Known home appliances, e.g., ovens, refrigerators, dishwashers, etc., have a kick plate which is secured to a base or lower-most region of the home appliance, i.e., where it can protect the home appliance against a person's shoes or debris from settling under the appliance. Further, the kick plate covers the lower-most region of the home appliance to provide a finished and complete look to the appliance while hiding appliance parts such as wiring, adjustment mechanisms, filters, pumps, etc.

The attachment of the kick plate should be sufficiently secure such that it does not come loose from the appliance once the appliance is installed, e.g., during use. Conventional approaches to secure the kick plate include using fasteners such as screws and bolts to secure the kick plate. These approaches make removal and/or re-attachment of the kick plate time consuming. In addition, because the fasteners can be seen on the outer surface, the kick plates are visually unappealing.

BRIEF SUMMARY

One aspect of the present technology relates to a home appliance including a movable front panel that may be used to secure the kick plate at a base of the home appliance.

An aspect of the present technology provides a kick plate assembly including two pieces, a pivoting panel and a slide-on kick plate fascia. The front panel may include or consist of a single piece of material with side members, each forming a perpendicular leg facing the rear on each end of the front panel. Each of the side members has two slots in them, a small vertical slot, and a larger curved slot with a small vertical portion above the smaller slot. There may be hems and/or a bead running along the face of the pivoting front panel to provide strength and rigidity as necessary. Additionally, there could be one or more punch outs which would be used as attachment points for the slide on kick plate fascia. The slide on kick plate fascia could roughly be a box with tabs extending down from the rear top flange. The tabs would be aligned with the corresponding punch outs on the pivoting panel. The tabs would allow the kick plate fascia to slide down and engage with the pivoting panel, securely attaching it without the use of any additional mechanical fasteners.

Another aspect of the present technology includes domestic appliance including a housing including an opening for accessing an interior compartment; a door for closing the opening; a pivoting panel to enclose at least a portion of a base portion of the appliance in a vertical orientation and expose at least a portion the base portion in a horizontal orientation; side members coupled to the pivoting panel; and pins coupled to the housing on an opposite end of the base portion. Each of the side members includes a first linear slot and a second slot including a linear portion and a curved portion. The first and second slots are configured to engage the pins such that the first slots and the linear portions of the second slots have a vertical orientation when the pivoting panel is in the vertical orientation and have a horizontal orientation when the pivoting panel is in the horizontal orientation.

Another aspect of the present technology includes a domestic appliance comprising: a shell; a door coupled to the shell; a treatment compartment defined at least in part by the shell and the door; a panel configured to enclose at least a portion of cavity below the treatment compartment in a vertical orientation and at least partially expose the cavity in a horizontal orientation; and an articulation arrangement to allow the panel to move from a closed and locked position to an unlocked and open position.

Another aspect of the present technology includes a domestic appliance comprising: a shell; a door coupled to the shell; a treatment compartment defined at least in part by the shell and the door; a panel configured to enclose at least a portion of a cavity below the treatment compartment; an articulation arrangement coupled to the shell and configured to allow the panel to move from a closed and locked vertical position to an unlocked and open non-vertical position whilst being coupled to the shell; and a locking mechanism configured to selectively lock the panel in the vertical position.

In examples, the domestic appliance can include one or more of the following features: (a) a kick plate fascia coupled to the planar surface of the panel; (b) the articulation arrangement is configured to provide a locking function when the panel is in the vertical orientation; (b) the locking mechanism is finger- or hand-operable to place the panel in a locked position or an unlocked position while the panel is in or substantially in the vertical position, and wherein once the locking mechanism is in the unlocked position, the panel is moveable via the articulation arrangement to a horizontal open position allowing access to the cavity; (c) the articulation arrangement comprises a first linear slot and a second slot including a linear portion and a curved portion extending from one end of the linear portion, the first linear slot engaging a first pin coupled to the shell or panel and the second slot engaging a second pin coupled to the shell or panel, the locking mechanism including the linear portion of the second slot and the second pin; (d) the locking mechanism comprises a magnet, a push pin and/or a latch; (e) the locking mechanism is positioned on the shell and/or the panel; (f) a first pair of pins coupled to the shell on one end of the cavity and a second pair of pins coupled to the shell on an opposite end of the cavity, and the panel includes a first side member configured to engage the first pair of pins and a second side member configured to engage the second pair of pins, the engagement of the pins and the side members enabling the panel to lift in a vertical direction to unlock the panel, and rotate the unlocked panel from the vertical position to allowing access to the cavity; and/or (g) the first linear slot and the linear portions of the second slot are oriented vertically when the panel is in the vertical orientation and are oriented horizontally when the panel is in the horizontal orientation, a size and shape of the first linear slot is the same as a size and/or shape of the linear portion of the second slot, and the first slot and the linear portion of the second slot are provided along a common axis.

Another aspect of the present technology includes a domestic appliance comprising: a housing including a base portion and an opening for accessing a treatment compartment of the housing; a door movable for at least partially closing the opening; a panel including a planar surface configured to enclose at least a portion of the base portion in a vertical orientation and expose at least a portion the base portion in a horizontal orientation; a first side member extending from one end of the panel in a perpendicular direction to the planar surface, and a second side member extending from an opposite end of the panel in the perpendicular direction; and a first pair of pins coupled to the housing on one end of the base portion and a second pair of pins coupled to the housing on an opposite end of the base portion, wherein the first side member is configured to engage the first pair of pins and the second side member is configured to engage the second pair of pins, the engagement of the pins and the side members enabling the panel in the vertical orientation to lift in a vertical direction to unlock the panel, and rotate the unlocked panel from the vertical orientation to at least partially expose the base portion.

In examples, the domestic appliance can include one or more of the following features: (a) each of the first and second side members includes a first slot that is linear and a second slot including a linear portion and a curved portion, the slots of the first side member are configured to engage the first pair of pins and the slots of the second side member are configured to engage the second pair of pins, and the first slots and the linear portions of the second slots are oriented vertically when the panel is in the vertical orientation and are oriented horizontally when the panel is in the horizontal orientation; (b) a kick plate fascia coupled to the planar surface of the panel; (c) the kick plate fascia is configured to slide on the panel and includes a plurality of tabs extending from a rear top flange of the kick plate fascia configured to engage corresponding punch outs in the panel; (d) the kick plate fascia is attached to the panel without use of additional mechanical fasteners; (e) one end of the curved portion extends from one end of the linear portion, the first slot engages one of the pins in the pair of pins and the second slot engages another one of pins in the pair of pins; (f) a size and shape of the first slots is the same as a size and/or shape of the linear portion of the second slots; (g) the domestic appliance includes a stove; (h) the first slot and the linear portion of the second slot are oriented in the same direction relative to the planar surface of the panel; (i) the curved portion extends from one end of the linear portion in a direction away from the planar surface of the panel; (j) the curved portion is provided along a radius measured from a center of bottom end of the first slot in the vertical orientation; (k) when the panel is in the vertical orientation, a first pin of the first and second pair of pins is positioned on one end of the first slots and a second pin of the first and second pair of pins is positioned on an end of the linear portion of the second slot; and when the panel is in the horizontal orientation, the first pin of the first and second pair of pins is positioned on an opposite end of the first slots and the second pin of the first and second pair of pins is positioned on an end of the curved portion of the second slot; (l) the engagement between the first slots and the pins in the first slots provides a pivotal movement between the vertical orientation and the horizontal orientation of the panel; and/or (m) the panel and the first and second side members consists of a single piece of material.

Another aspect of the present technology includes a pivoting kick plate assembly comprising: a pivoting panel including a planar surface configured to enclose at least a portion of a base portion of a domestic appliance in a vertical orientation and expose at least a portion the base portion in a horizontal orientation; a kick plate fascia coupled to the planar surface of the pivoting panel; a first side member extending from one end of the pivoting panel in a perpendicular direction to the planar surface, and a second side member extending from an opposite end of the pivoting panel in the perpendicular direction; and a first pair of pins coupled to housing or a frame of the appliance on one side of an opening to the base portion and a second pair of pins coupled to the housing or frame on an opposite side of the opening to the base portion, wherein each of the first and second side members includes a first slot that is linear and a second slot including a linear portion and a curved portion, the slots of the first side member are configured to engage the first pair of pins and the slots of the second side member are configured to engage the second pair of pins, and the first slots and the linear portions of the second slots are oriented vertically when the pivoting panel is in the vertical orientation and are oriented horizontally when the pivoting panel is in the horizontal orientation.

In examples, the pivoting kick plate assembly can include one or more of the following features: (a) the kick plate fascia is configured to slide on the pivoting panel and includes a plurality of tabs extending from a rear top flange of the kick plate fascia configured to corresponding punch outs in the pivoting panel; (b) a size and shape of the first slots is the same as a size and/or shape of the linear portion of the second slots, and the first slot and the linear portion of the second slot of the same side member are provided along a common axis; and/or (c) the curved portion extends from one end of the linear portion in a direction away from the planar surface of the pivoting panel.

Another aspect of the present technology includes a domestic appliance comprising: a shell; a door coupled to the shell; a treatment compartment defined at least in part by the shell and the door; a pivoting panel configured to enclose at least a portion of cavity below the treatment compartment in a vertical orientation and at least partially expose the cavity in a horizontal orientation; a kick plate removably coupled to the pivoting panel; and a first pair of pins coupled to the shell on one end of the cavity and a second pair of pins coupled to the shell on an opposite end of the cavity; wherein the pivoting panel includes a first side member configured to engage the first pair of pins and a second side member configured to engage the second pair of pins, the engagement of the pins and the side members enabling the pivoting panel to lift in a vertical direction to unlock the pivoting panel, and rotate the unlocked pivoting panel from the vertical orientation to at least partially expose the cavity.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

The accompanying drawings facilitate an understanding of the various examples of this technology. In such drawings.

DETAILED DESCRIPTION OF EXAMPLES OF THE TECHNOLOGY

Before the present technology is described in further detail, it is to be understood that the technology is not limited to the particular examples described herein, which may vary. It is also to be understood that the terminology used in this disclosure is for the purpose of describing only the particular examples discussed herein, and is not intended to be limiting.

The following description is provided in relation to various examples which may share one or more common characteristics and/or features. It is to be understood that one or more features of any one example may be combinable with one or more features of another example or other examples. In addition, any single feature or combination of features in any of the examples may constitute a further example.

The present technology describes a kick plate assembly that may be included in a home appliance. The home appliance may be a washer, dryer, washer/dryer combination, oven, stove, refrigerator, and/or freezer, dishwasher etc. The home appliance may include a treatment compartment for receiving items to be treated, e.g., cleaned, dried, heated, cooled, etc. In some examples, the home appliance may include one or more heating and/or cooling elements inside or outside of the treatment compartment for treating, e.g., heating and/or cooling the treatment compartment, and items placed therein. A door assembly including one or more doors may be movably engaged (e.g., hinged) with the home appliance to provide access to the treatment compartment and at least partially enclose the treatment compartment.

Figure 1:
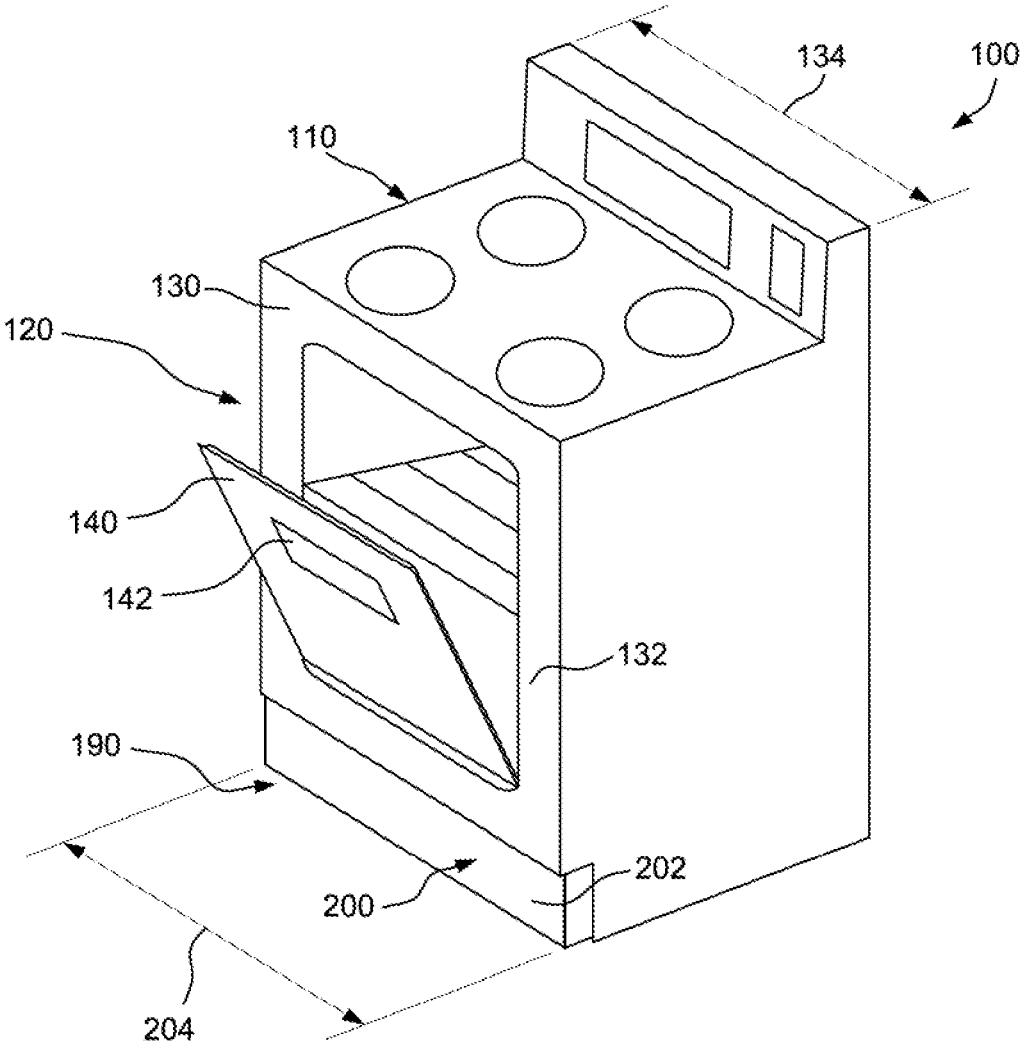
FIG. 1 is a perspective view of a home appliance including a movable front panel with a kick plate fascia in accordance with one form of the present technology.

FIG. 1 is a perspective view of a home appliance 100 including a kick plate assembly 200 in accordance with one form of the present technology. FIG. 1 shows a home appliance 100 including a stove and a cooktop, however examples of the present technology are not so limited.

The home appliance 100 shown in FIG. 1 includes a cooktop 110 for heating food placed on a top surface using one or more heating elements and a treatment compartment 120, e.g., an oven including one or more heating and/or cooling elements (not shown) inside or outside of an treatment compartment for heating the treatment compartment. The treatment compartment is defined by a shell 130 and a door assembly 140 movably engaged (e.g., hinged) with the shell 130 e.g., about a lower end of the compartment. The door assembly 140 may include a handle 142 disposed on an outside surface of the door. In some examples, the door assembly 140 may include a plurality of doors providing access to different compartments provided on a same side and/or different sides of the appliance 100.

The appliance 100 may include a kick plate assembly 200 located generally below the door assembly 140. The kick plate assembly 200 may be a pivoting kick plate assembly configured to provide selective access to a base portion 190 of the appliance 100. The base portion 190 may be an area near a bottom of the appliance 100 e.g., below the treatment compartment 120 and the door assembly 140. The base portion 190 may be at least partially defined by side of the appliance 100, bottom surface of the appliance 100 and/or a surface on which the appliance 100 is placed.

In FIG. 1, the kick plate assembly 200 is shown covering a base portion 190 that is on the same side of the appliance as the treatment compartment 120 and door assembly 140. In some examples, the kick plate assembly 200 may be provided on a different side of the appliance from the treatment compartment 120 and the door assembly 140. In some examples, the kick plate assembly 200 may be provided on multiple sides.

A front surface 202 of the kick plate assembly 200 is parallel to and rearwardly offset from a front surface 132 of the appliance 100 and/or the door assembly 140 towards the back (shown in FIG. 1) or towards the front of the appliance 100. In some examples, the front surface of the kick plate assembly 200 and the front surface of the appliance and/or the door assembly 140 may be provided on a common plane. In some examples, the front surface of the kick plate assembly 200 and the front surface of the appliance 100 and/or the door assembly 140 may be provided on a common plane.

The kick plate assembly 200 may have a width 204 that corresponds to a width 134 of the appliance 100. In some examples, the kick plate assembly 200 may be approximately 30", 36", 48" and 60", and/or a couple of inches tall and deep. The kick plate assembly 200 may have a shape (e.g., rectangular shape) corresponding to an opening in the base portion of the appliance 100. The opening in the base portion of the appliance 100 may be partially or completely enclosed by the kick plate assembly 200 in the vertical orientation. The kick plate assembly 200 may extend from one side of the appliance to the other side of the appliance so that the ends of the kick plate assembly are approximately flush with the sides of the appliance 100.

The kick plate assembly 200 is capable of pivoting from a vertical position, in which access to the base portion is prevented, to a flat orientation or non-vertical orientation in which access inside or below to the base portion is made available. Access to the base portion may be needed to gain access to one or more appliance components (e.g., motor, circuit breakers, and/or leveling mechanisms) for repair or adjustment. In some examples, the base portion may be used to store items such as accompanying appliance documentations, specialized tools or replacement parts for the appliance 100, and/or optional attachments (e.g. additional racks for oven).

The kick plate assembly 200 according to one or more forms of the present technology combines functionality with simplistic design. The kick plate assembly 200 provides a front panel on the appliance 100 (e.g., oven ranges) which is capable of pivoting (rotating out to a flat orientation from an initial vertical position). In an example, the pivoting is enabled by solely relying on integrated cut outs provided in the kick plate assembly 200, without including any additional mechanical hardware, such as hinges used in hinged storage doors. Hinges in hinged storage doors are complex, costly and/or need specifically positioned mounting points. Examples of the present technology overcome or more of these drawbacks. In addition, the kick plate assembly 200 according to one or more forms of the present technology allows for the kick plate assembly 200 to remain attached while allowing user access to the base portion and/or decreases the amount of parts needed to attach critical documentation to oven ranges and/or enhances the premium design of ranges by creating a secure attachment of the kick plate to the range, while making it easier to remove and service.

The kick plate assembly 200 according to one or more forms of the present technology provides an articulation arrangement allowing the kick plate to move from a closed and locked vertical position to an unlocked and open horizontal (or non-vertical) position. The articulation arrangement may include at least one pair of pins and slots (or two pairs of pins and slots). The articulation arrangement is configured to provide the locked and closed position, an unlocked closed position, and an unlocked open position. The locked position may be provided by a locking mechanism, e.g., one of the pairs of pins and slots, or the locking mechanism or position may be provided as part of the kick plate assembly, e.g., one or more magnets, latches or push pins, separate from the pin/slot arrangement. The locking mechanism may be finger- or hand-operable to place the panel in a locked position and an unlocked position while the panel is in or substantially in the vertical position. Examples of the articulation arrangement are shown in FIGS. 2A-9C.

Figure 2A:
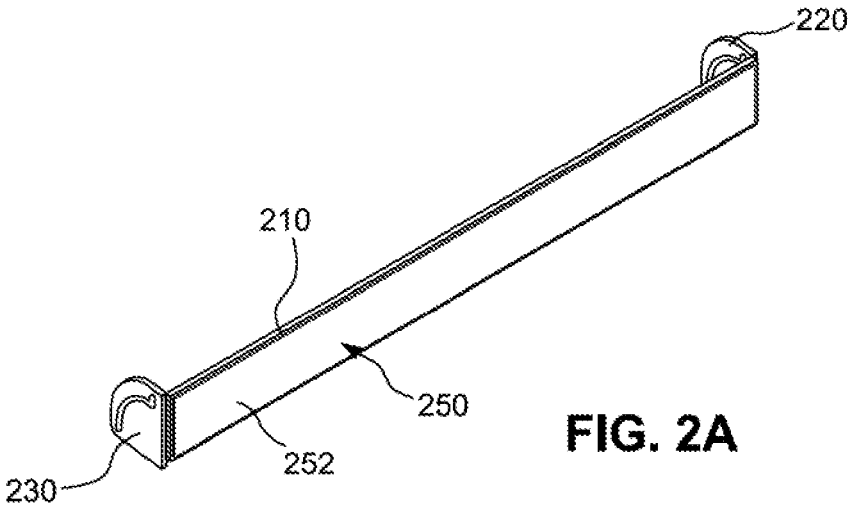
FIG. 2A shows a front perspective view of a kick plate assembly in accordance with one form of the present technology.
Figure 2B:
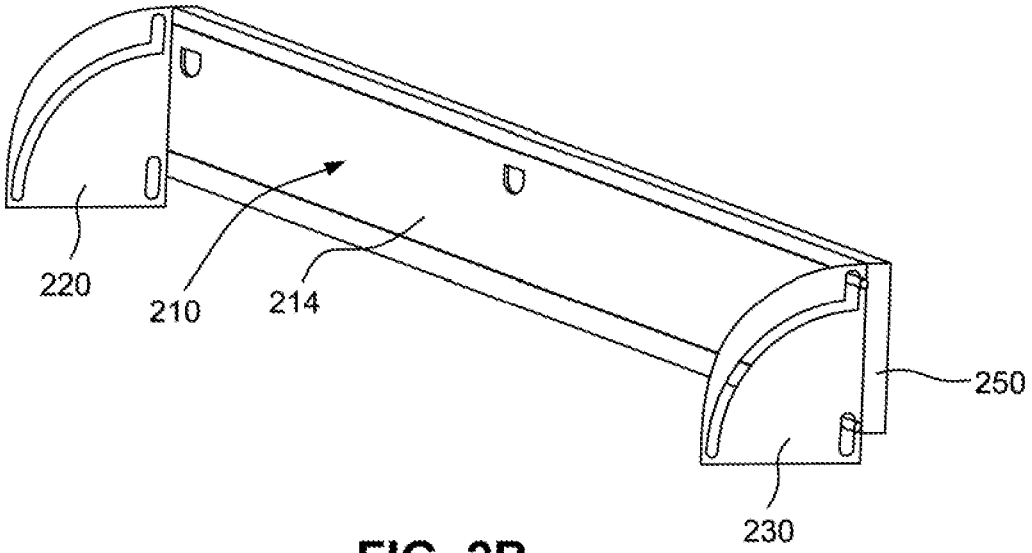
FIG. 2B shows a back perspective view of a kick plate assembly in accordance with one form of the present technology.
Figure 3A:
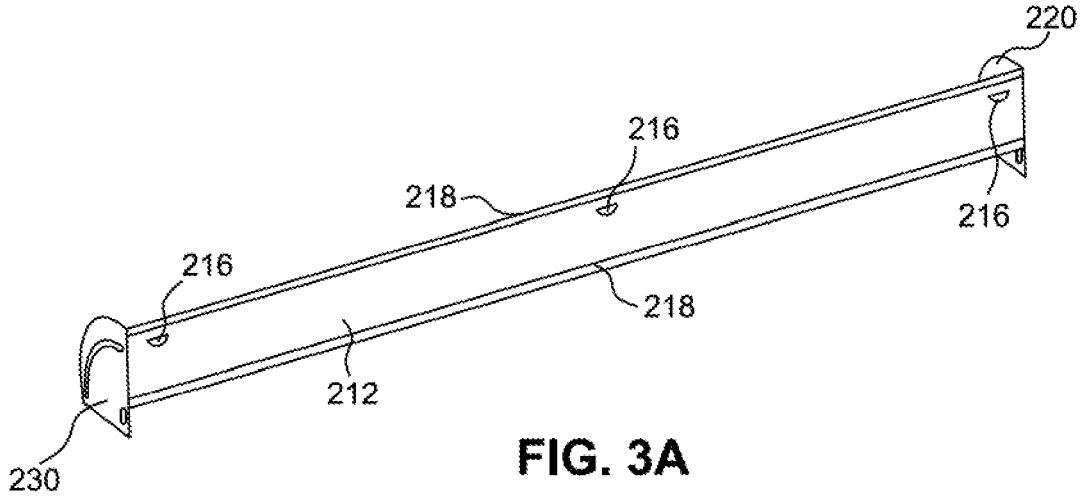
FIG. 3A shows a front perspective view of a front panel and first and second side members in accordance with one form of the present technology.
Figure 3B:
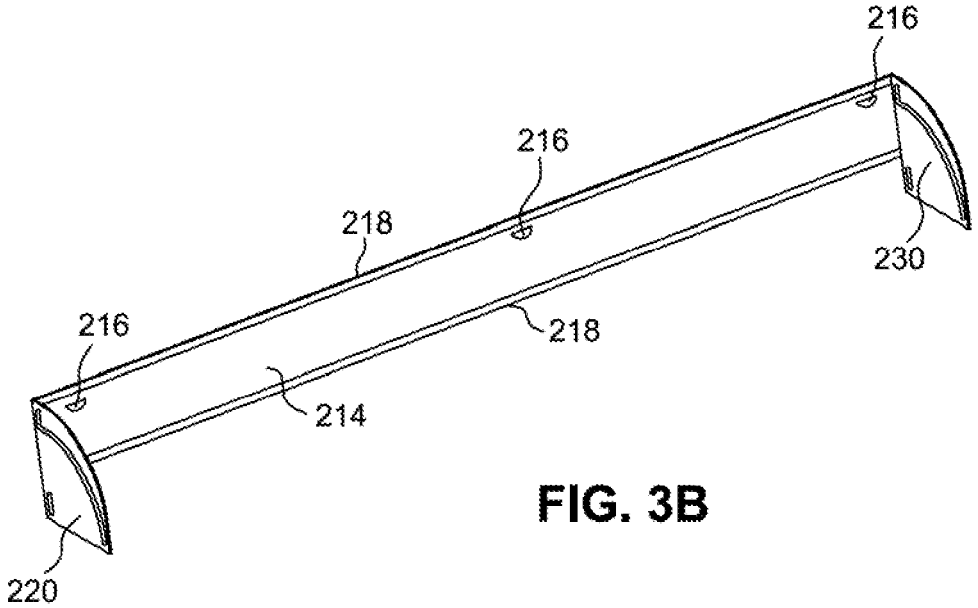
FIG. 3B shows a back perspective view of a front panel and first and second side members in accordance with one form of the present technology.

FIGS. 2A and 2B show perspective views of a kick plate assembly 200 in accordance with one form of the present technology. The kick plate assembly 200 includes a front panel 210 to which a kick plate fascia 250 (shown in FIGS. 4A and 4B) is attached. The front panel 210 without the kick plate fascia 250 being attached is shown in FIGS. 3A and 3B. The front panel 210 includes a first side member 220 and a second side member 230 for movably coupling the kick plate assembly 200 to the appliance 100. The engagement between stationary pins in the appliance and slots in the first side member 220 and the second side member 230 allows the kick plate assembly 200 to move from a locked position to an unlocked position and pivotally move from a vertical orientation to a non-vertical orientation (e.g., horizontal orientation).

FIGS. 3A and 3B show perspective views of a front panel 210 and first and second side members 220 and 230 in accordance with one form of the present technology. The front panel 210 can be referred to as a pivoting panel due to the specific engagement of the first and second side members 220 and 230 with the appliance enabling the front panel 210 to pivot about an axis.

The front panel 210 may be formed of a solid material (e.g., metal, polymer material or other appropriate material) and/or shaped from a flat surface. A planar surface of the front panel includes a front surface 212 and a back surface 214, one or both of which may be flat and continuous. The front surface 212 and/or the back surface 214 may include hems and/or a bead 218 extending along the length of the front surface 212 and/or the back surface 214 to provide strength and rigidity as necessary. The hems and/or a bead 218 may be provided near and/or as part of the top and/or bottom sides of the front panel.

The first side member 220 and the second side member 230 are provided on the front panel 210 and provide a mechanism for the front panel 210 to pivotally move from a vertical orientation to a non-vertical orientation (e.g., horizontal orientation). In the vertical orientation the front panel 210 is configured to enclose at least a portion of the base portion of the appliance 100 and in the non-vertical orientation or horizontal orientation the font panel is configured to expose at least a portion of the base portion of the appliance 100.

Each of the first side member 220 and the second side member 230 may be coupled to a back surface 214 and/or sides of the front panel 210. The first and second side members may be permanently (e.g., welded) or removably (e.g., using fasteners) coupled to the front panel 210. In some examples, the first and second side members and the front panel 210 may be formed from a same piece of material bent to form perpendicular legs (e.g., side members) facing the rear on either end of the front panel 210.

Figure 4A:
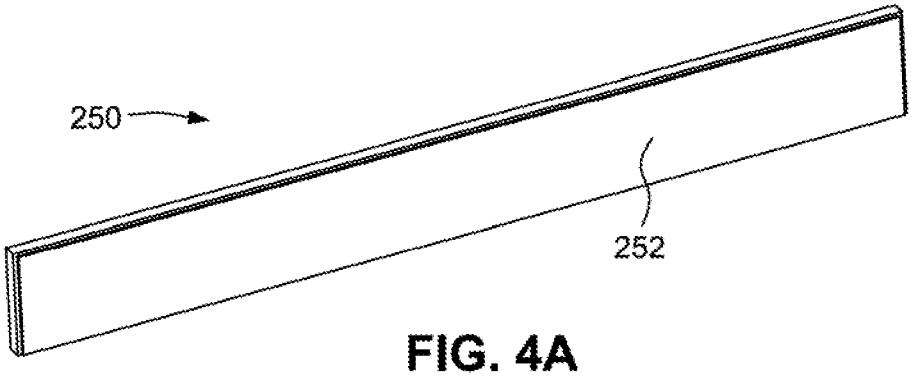
FIG. 4A shows a front perspective view of a kick plate fascia in accordance with one form of the present technology.
Figure 4B:
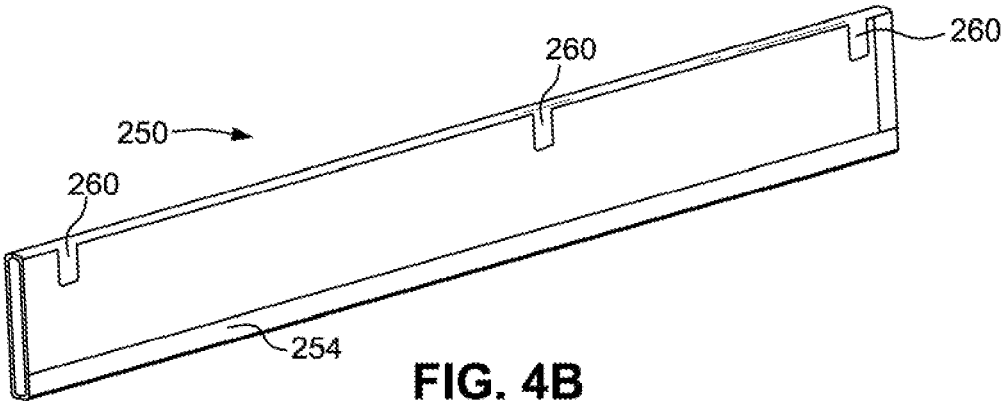
FIG. 4B shows a back perspective view of a kick plate fascia in accordance with one form of the present technology.

FIGS. 4A and 4B show perspective views of a kick plate fascia 250 in accordance with one form of the present technology. The kick plate fascia 250 may provide a cosmetic surface (e.g., a cosmetic kick plate) that matches in color and/or texture with one or more surfaces of the appliance 100.

The kick plate fascia 250 may be formed of a solid material (e.g., metal, polymer material or other appropriate material) and/or shaped from a flat surface. The front surface 252 of the kick plate fascia 250 may be flat and continuous. In some examples, the kick plate fascia 250 may be formed from a single piece of material into a rectangle having a length, height and a width. The kick plate fascia 250 may be formed from a single piece of material to provide front surface 252 and side surfaces provided perpendicular to the front surface 252 on each edge of the front surface 252 and a back surface 254.

As shown in FIG. 4B, the bottom of the kick plate fascia 250 may include a U-shaped channel extending along the length of the kick plate fascia 250. The U-shaped channel may be formed by a portion of the front surface 252, the bottom side surface and a back surface 254 provided parallel to the front surface 252. The back surface 254 may extend upwards partially from the bottom side surface. When the front panel 210 and the kick plate fascia 250 are assembled, the back surface 254 may rest against the front panel 210 and/or the first side member 220 and the second side member 230.

The kick plate fascia 250 may include one or more tabs 260 extending down from the rear top flange 258. In the example shown in FIGS. 4A and 4B, three tabs 260 are provided with one generally in the center of the kick plate fascia 250 and two tabs 260 near each end of the kick plate fascia 250. The one or more tabs 260 are configured to engage one or more attachment features 216 provided in the front panel 210 to attach the kick plate fascia 250 to the front panel 210.

Figure 5A:
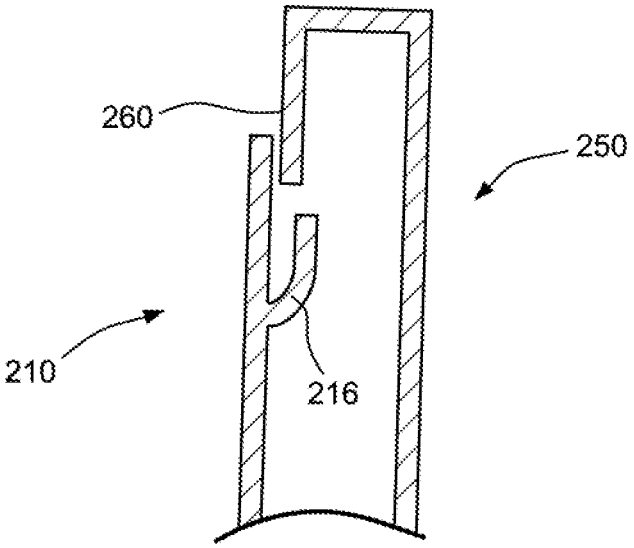
FIG. 5A shows an example of engagement between an attachment features and tabs provided on a kick plate fascia in accordance with one form of the present technology.

FIG. 5A shows an example of engagement between an attachment features 216 and tabs 260 provided on the kick plate fascia 250 in accordance with one form of the present technology. The attachment features 216 may include punch outs (shown as louvers) in the front panel 210 configured to engage tabs 260. To assemble, the tabs 260 would be aligned with the corresponding punch outs on the front panel 210. The tabs 260 allow the kick plate fascia 250 to slide down and engage with the front panel 210, securely attaching the kick plate fascia 250 without the use of any additional mechanical fasteners, but additional mechanical fasteners like bolts, screws etc. could be used to help secure the kick plate fascia 250 to the front panel 210. For example, a screw or bolt could be used to secure the tabs 260 to the attachment features 216.

In one example, the tabs 260 could engage the corresponding punch outs on the front panel from a front surface 212 of the front panel 210. The kick plate fascia 250 could be attached to the front panel 210 with the front panel 210 in horizontal or non-vertical orientation without needing to remove the front panel 210 from the appliance. The present technology allows for the kick plate fascia 250 to be easily replaced if the front panel is damaged or a different style is desired.

FIG. 2B shows the punch out and engagement flange in the attached position, where they are held together with an interference fit. Sliding the kick plate fascia 250 up vertically would cause the kick plate fascia 250 to detach and separate.

Figure 5B:
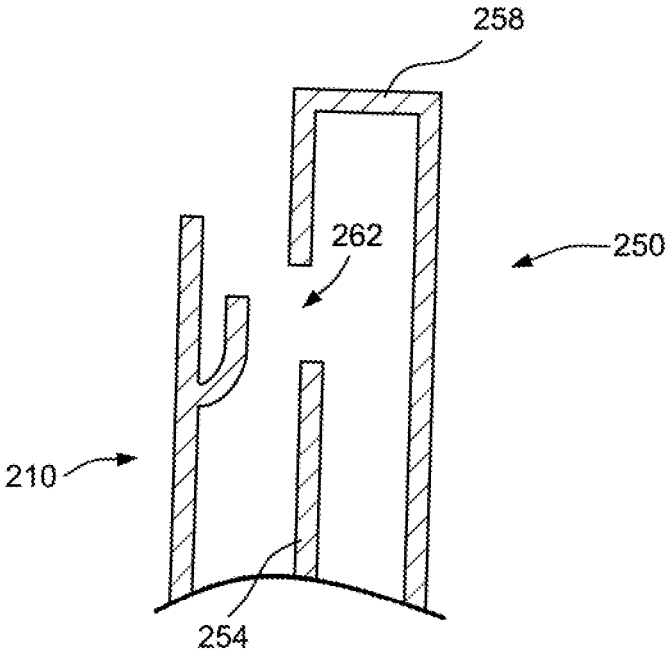
FIG. 5B shows another example of engagement between an attachment features and a kick plate fascia in accordance with one form of the present technology.

FIG. 5B shows another example of engagement between an attachment features 216 and the kick plate fascia 250 in accordance with one form of the present technology. In FIG. 5B, the back surface 254, which may extend from the bottom to the top of the kick plate fascia 250 is provided with one or more holes 262 configured to receive attachment features 216 of the front panel 210. Other means known to a person of ordinary skill in the art could be used to permanently or removably secure the kick plate fascia 250 to the front panel 210.

FIGS. 6A-6D show side views of the engagement between a side member 220(230) and pins 232 and 234 in accordance with one form of the present technology. The pins 232 and 234 are coupled to a frame or housing of the appliance 100 and are configured to engage slots provided in the first and second side members. The pins may be permanently secured to the frame or housing or removable mounted. A first pair of pins is provide near one end of the base portion and a second pair of pins is provided near an opposite end of the base portion. The pins remain stationary during the movement of the kick plate assembly 200. The first pins 232 of the two pairs of pins may be provided along a first common axis and second pins 234 of the two pair of pins may be provided along a second common axis that is parallel to the first common axis and offset in a vertical direction. The first and second common axes may be parallel to a front surface 132 and/or door of the appliance 100. The pins on one side may be vertically aligned, or could be offset in a horizontal direction.

Each of the first and second side members includes a first slot 236 engaging a first pin 232 and a second slot 240 engaging a second pin 234. The first slot 236 is linear and is oriented vertically when the front panel 210 and/or the kick plate fascia 250 are in the vertical orientation (see FIG. 6A) and are oriented horizontally when the front panel 210 and/or the kick plate fascia 250 are in the horizontal orientation (see FIG. 6D). The second slot 240 includes a linear portion 242 and a curved portion 244. The linear portion 242 of the second slot 240 is oriented vertically when the movable front panel 210 is in the vertical orientation and is oriented horizontally when the movable front panel is in the horizontal orientation. The curved portion 244 of the second slot 240 is generally curved by a smooth curved slot or a plurality of straight slots. The curved portion 244 is not limited to the specific shape shown in the figures. The curved portion 244 provides a shape to constrain movement of the kick plate assembly 200 along a rotational path, while providing a pivot like motion from a vertical orientation to a non-vertical orientation (e.g., horizontal orientation).

Figure 6A:
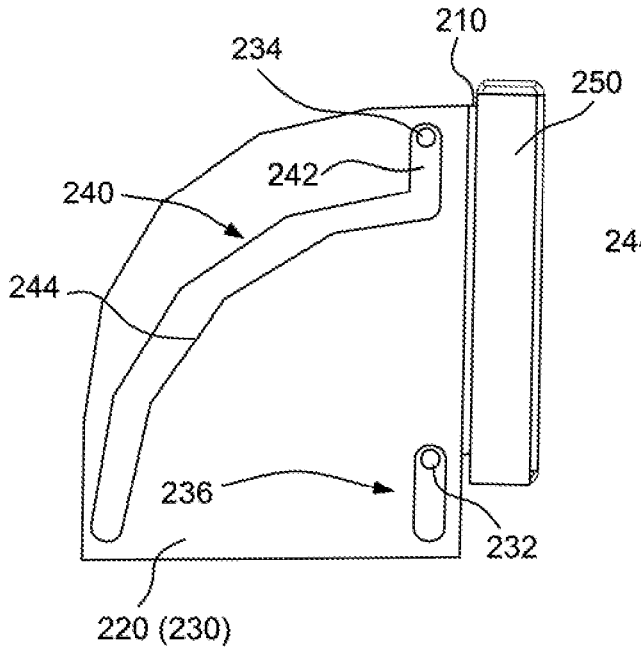
FIG. 6A shows side view of the engagement between the side members and pins in a closed/locked position, in accordance with one form of the present technology.

As shown in FIG. 6A, in the vertical orientation the kick plate assembly 200 is in the closed/locked position. In the vertical orientation, the weight of the kick plate assembly 200 causes the kick plate assembly 200 to drop down and lock in on pins 232 and 234. With the pins 232 and 234 pressed against the top surface of the linear slot portions of the first slot 236 and the second slot 240, rotation of the kick plate assembly 200 is prevented.

When the kick plate assembly 200 is in the vertical orientation (closed/locked position shown in FIG. 6A), the first pin 232 is positioned on one end of the first slot 236 and the second pin 234 is positioned on one end of the linear portion 242 of the second slot 240. The kick plate assembly 200 can be held in this position via gravity, but the locking position could be secured by using a spring to bias the assembly in the position shown in FIG. 6A. By vertically lifting the kick plate assembly 200 a short distance (i.e. distance equal to length of the first slot 236), the second pin 234 moves to an opposite end of the linear portion 242 and enters the start of curved portion 244 of the second slot 240 (see unlocked closed position in FIG. 6B). In response to lifting, the first pin 232 is also moved to an opposite end of the first slot 236 providing a pivot point for the kick plate assembly 200 to rotate around. After the kick plate assembly 200 is lifted, the second pin 234 is moved along the curved portion 244 causing the kick plate assembly 200 to rotate about the first pin 232 (see unlocked partially opened position in FIG. 6C) from the vertical orientation to a horizontal orientation. When the kick plate assembly 200 is in the horizontal orientation (see unlocked opened position shown in FIG. 6D), the first pin 232 is positioned on an opposite end of the first slot 236 and the second pin 234 is positioned on an end of the generally curved portion 244 of the second slot 240.

Figure 6B:
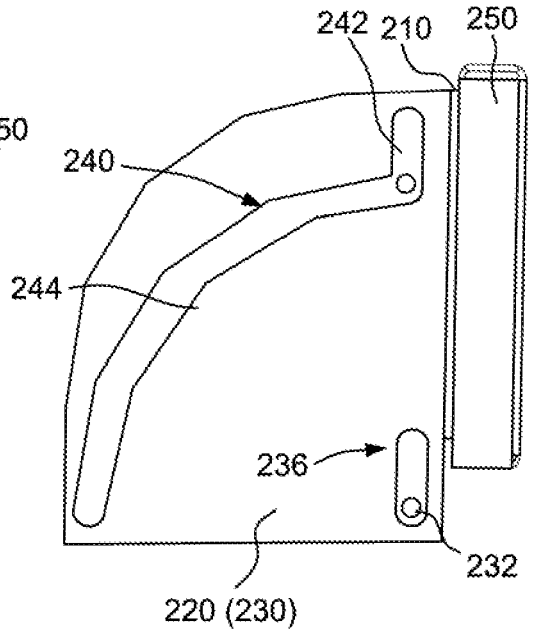
FIG. 6B shows side view of the engagement between the side members and pins in a lifted position, in accordance with one form of the present technology.
Figure 6C:
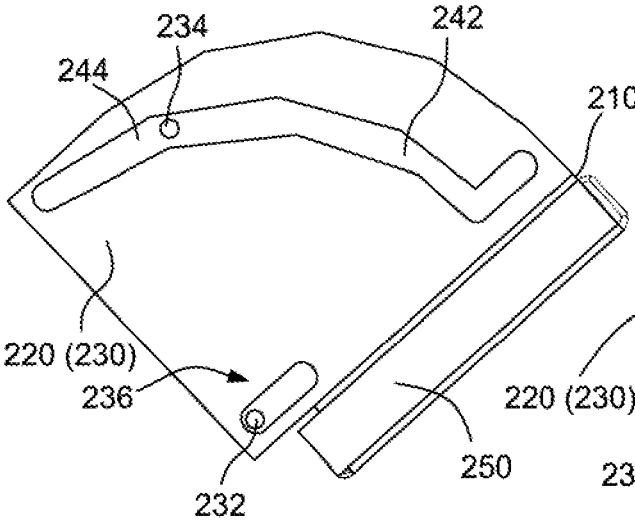
FIG. 6C shows side view of the engagement between the side members and pins in a partially opened position, in accordance with one form of the present technology.
Figure 6D:
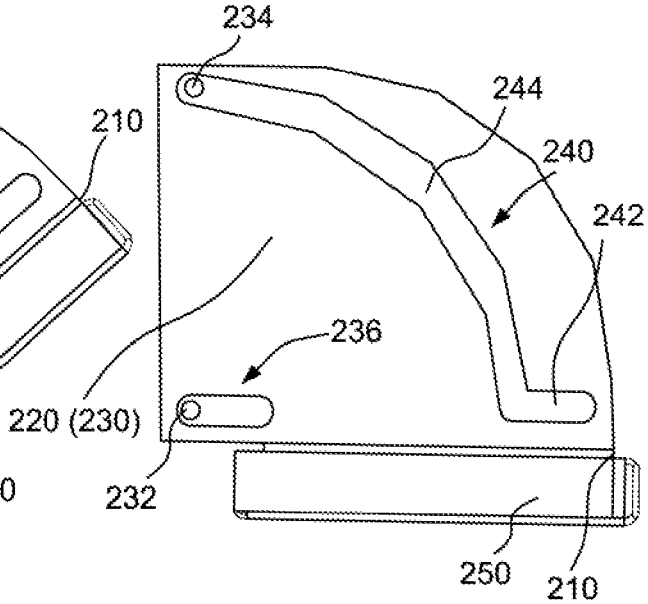
FIG. 6D shows side view of the engagement between the side members and pins in an opened position, in accordance with one form of the present technology.

The linear portion 242 of the second slot 240 and the pin 234 can be part of the locking mechanism configured to selectively lock the front panel 210 in the vertical position. The engagement of the linear portion 242 the pin 234 as shown in FIG. 6A provided for a locked position and the engagement of the linear portion 242 the pin 234 as shown in FIG. 6B provides for an unlocked position. Once in the unlocked position, the front panel 210 can be moved (e.g., rotated) with a finger- or hand-operation to an intermediate position (see partially opened position) FIG. 6C and to the opened position (see FIG. 6D).

As shown in FIGS. 6A-6D, the kick plate assembly 200 can be moved from the closed potion to the opened position (via a "lift- and rotate" motion) while still being connected to the appliance via the pins 232 and 234. This allows for the quick access to a bottom portion of an appliance without needing to disassemble and reassemble the appliance. In addition, in the open or partially open position, the kick plate fascia 250 can be replaced without needing to remove the front panel 210 from the appliance.

The size and/or shape of the first slot 236 can be the same as the size and/or shape of the linear portion 242 of the second slot 240. The first slot 236 and the linear portion 242 of the second slot 240 may be elongated holes with full radii on both ends. The first slot 236 and the linear portion 242 of the second slot 240 of the same side member can be provided along a same axis, which is parallel to the front surface of the front panel 210 and/or the kick plate fascia 250. In some examples, the first slot 236 and the linear portion 242 of the second slot 240 oriented such that they are in parallel.

The curved portion 244 of the second slot 240 may extend from one end of the linear portion 242 in a direction away from the planar surface of the front panel 210 and/or the kick plate fascia 255. The curved portion 244 may be provided along a radius that is a predetermined distance from the lower end of the first slot 236. As shown in FIGS. 6A-D, the curved portion 244 may end at a same distance from the bottom side of the side members 220 or 230. In some examples, the curved portion 244 of the second slot 240 may terminate earlier, preventing the kick plate assembly 200 from reaching a horizontal orientation in the opened position.

Figure 7:
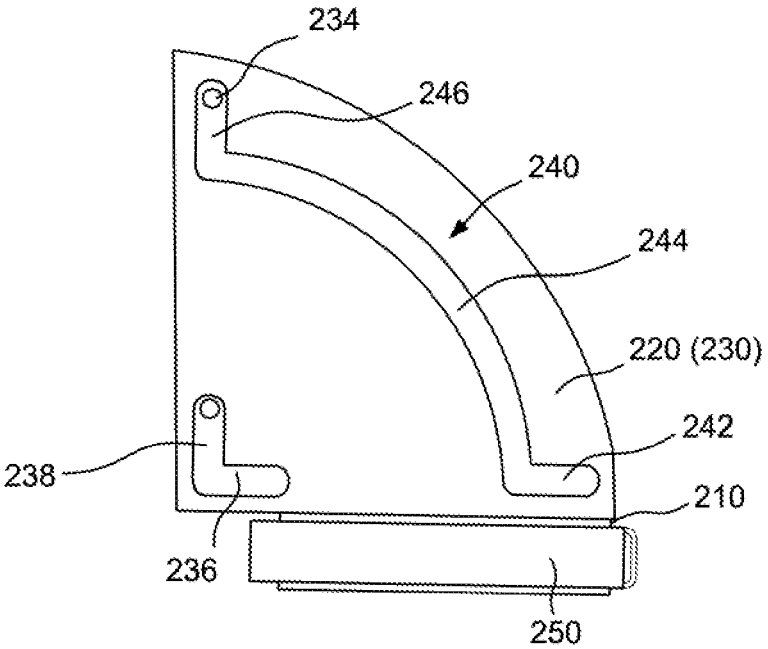
FIG. 7 shows side view of the engagement between the side members and pins in an opened position locked, in accordance with one form of the present technology.

FIG. 7 shows side view of the engagement between the side members and pins in an opened locked position, in accordance with one form of the present technology. In FIG. 7, a locked opened position is provided by including a linear slot portions 238 and 246 in the first slot 236 and the second slot 240, respectively. In this example, after the kick plate assembly 200 is rotated to a horizontal orientation, the kick plate assembly 200 is moved downward by gravity (possibly with the assistance of a spring, as with the closed locked position). The downward movement of the kick plate assembly 200 moves the first and second pins 232 and 234 into the additional linear portion 238 of the first slot 236 and the additional linear portion 246 of the second slot 240. The kick plate assembly 200 is removed from the locked opened position by lifting the kick plate assembly 200 upwards so that the pins 234 engages the curved portion 244 of the second slot 240.

Figure 8:
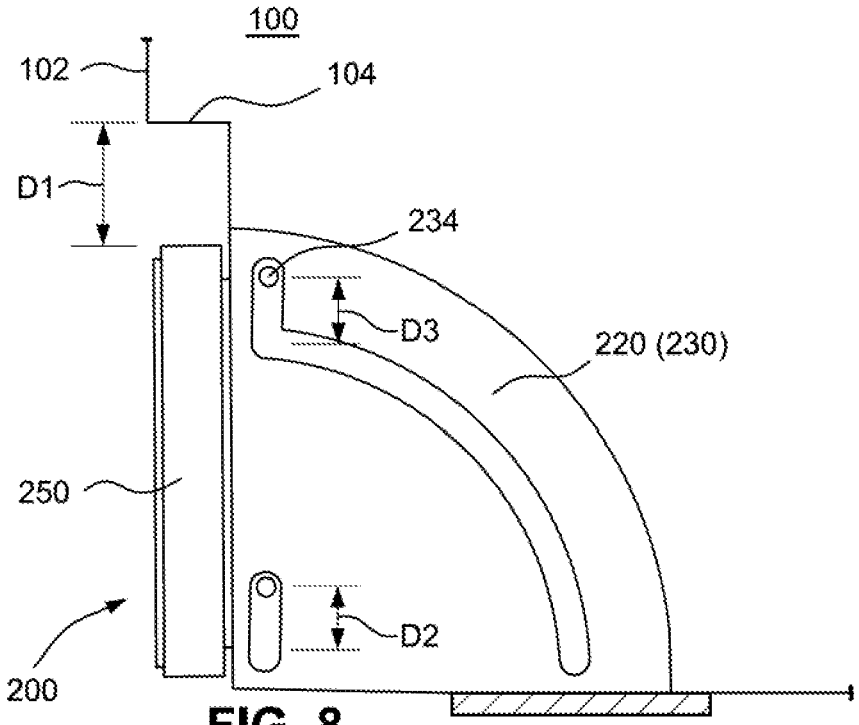
FIG. 8 shows an arrangement of the kick plate assembly on an appliance in accordance with one form of the present technology.

FIG. 8 shows an arrangement of the kick plate assembly 200 on an appliance in accordance with one form of the present technology. In FIG. 8, a front surface of the kick plate fascia 250 is provided on approximately a same plane with a front surface 102 of the appliance 100. The positioning of the pins 232 and 234 and the slots 236 and 240 may be positioned such that a space having a distance D1 is provided between an edge 104 of the appliance 100 and the top of the kick plate fascia 250. The distance D1 may be equal to or exceed a distance D2 between full radii on ends of the first slot 236. The distance D2 may equal the distance D3 between full radii on ends of the linear portion 242 of the second slot 240. Providing the space between the edge 104 of the appliance 100 and the top of the kick plate fascia 250 may ensure that there is sufficient space to move the second pin 234 to a portion of the second slot 240 so that the second pin 234 can engage the curved portion 244 of the second slot 240.

Figure 9A:
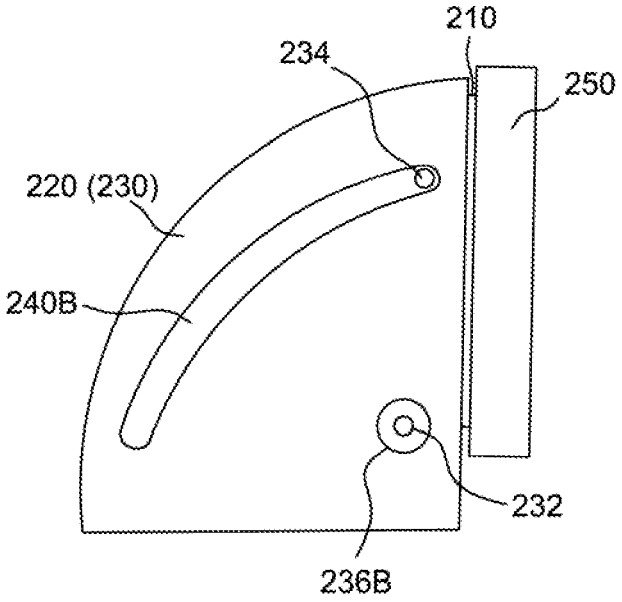
FIG. 9A shows a side member of a kick plate assembly in accordance with one form of the present technology.
Figure 9B:
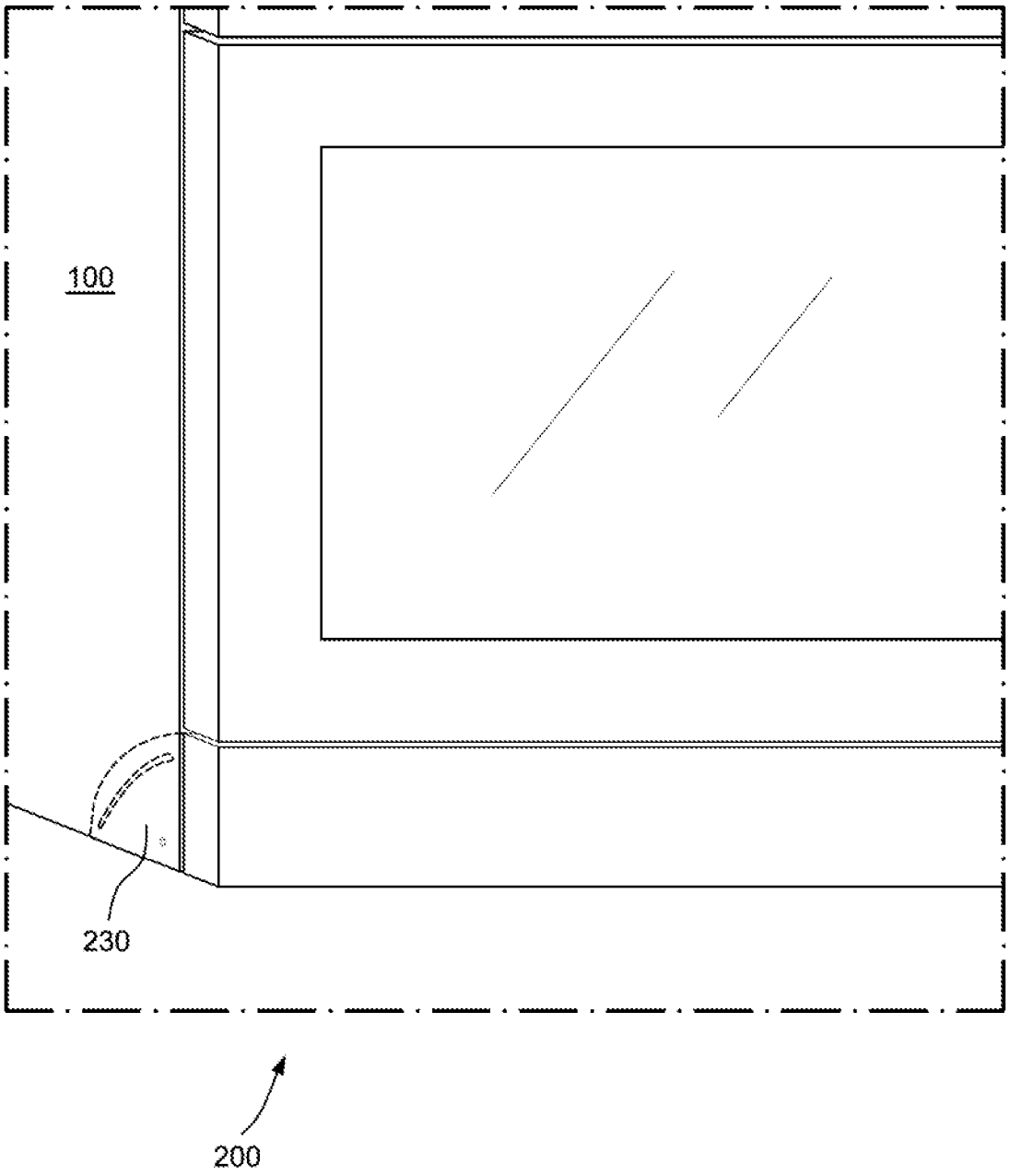
FIG. 9B shows a kick plate assembly shown in FIG. 9A in a closed/locked position on an appliance in accordance with one form of the present technology.
Figure 9C:
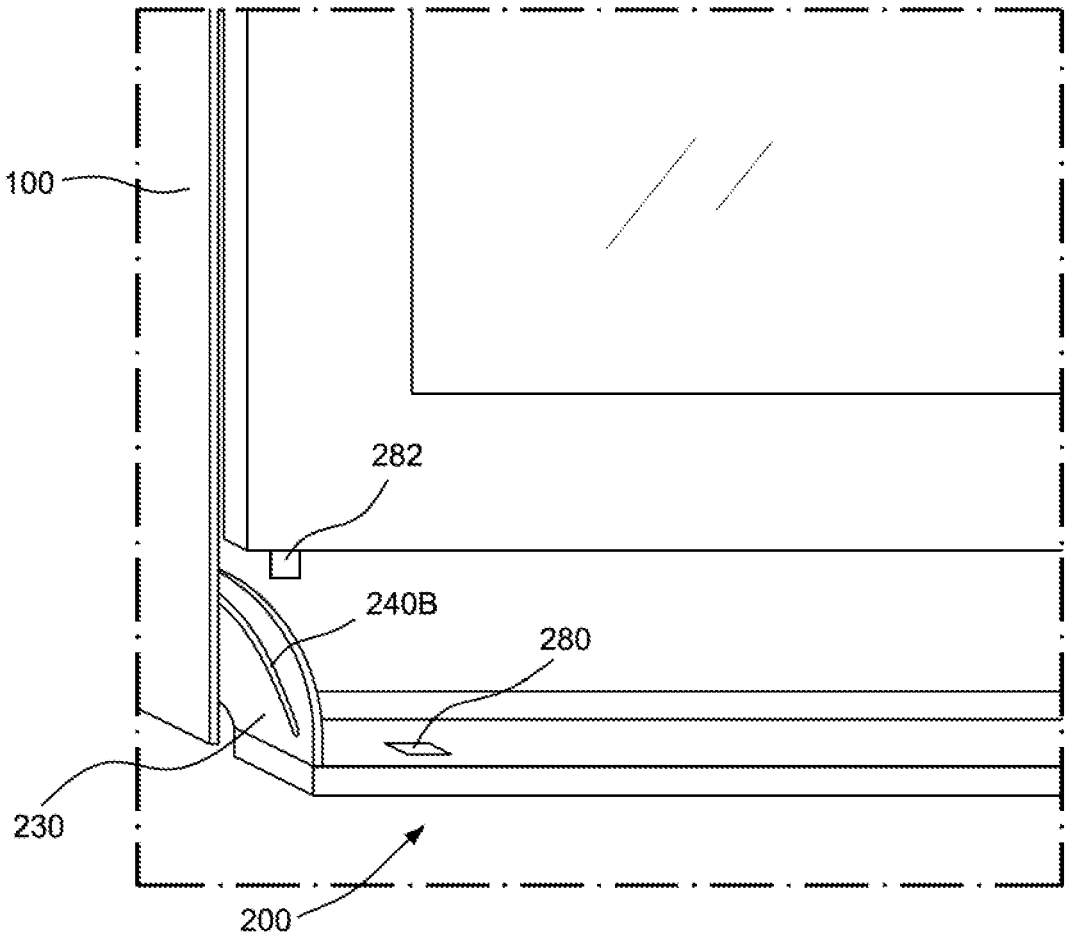
FIG. 9C shows the kick plate assembly shown in FIG. 9A in an open position on an appliance in accordance with one form of the present technology.

FIGS. 9A-9C show a kick plate assembly attached to on an appliance 100 in accordance with one form of the present technology. In the example shown in FIG. 9A-9C, the first side member 220 and the second side member 230 include a slot 236*b* in form of a hole configured to receive first pin 232 and a curved slot 240*b* to receive the second pin 234. The slot 236*b* provides a point about which the kick plate assembly rotates as the second pin 234 moves from one end of the curved slot 240*b* to the other end of the curved slot 240*b*. As the second pin 234 is moved from one end to the other end of the curved slot 240*b*, the kick plate assembly is moved from a vertical orientation in the closed position to a horizontal orientation in the open position.

The kick plate assembly is locked in place by a locking mechanism, which may include a first lock member 280 provided on the front panel 210 and a second lock member 282 provided on the appliance 100. In some examples, the locking mechanism may be provided only on the front panel 210 or the shell of the appliance. The locking mechanism may include a magnetic locking mechanism, a push pin and/or a latch (e.g., a push open latch and/or a push on fitting).

In the example shown in FIGS. 9A-9C, the kick plate assembly does not need to be lifted upwards to unlock the kick plate assembly. In this example, the kick plate assembly can be provided closer to the front surface of the appliance and/or the door so that there is less space between the kick plate assembly and other part of the appliance above the kick plate assembly.

Examples of this technology are not limited to slots extending through the first and second side members. In some examples, the slots may extend only up to a blind depth.

Examples of this technology are not limited to the specific shapes of slots shown in the figures. Examples of this technology may be applied to side members including only two slots with other shapes enabling the kick plate fascia 250 to pivot from a vertical orientation to a horizontal orientation. For example, the linear first slot 236 and the linear portion 242 of the second slot 240 could be replaced with another shape (e.g., zig zag slot or a curved slot). In some examples, the pins may be provided on the side member and plates including slots for engaging the pins may be coupled to the frame of the appliance. In this example, the pins could be providing on the side members along a common horizontal direction.

While the technology has been described in connection with what are presently considered to be the most practical and preferred examples, it is to be understood that the technology is not to be limited to the disclosed examples, but on the contrary, is intended to cover various modifications and equivalent arrangements included within the spirit and scope of the disclosure. Also, the various examples described above may be implemented in conjunction with other examples, e.g., aspects of one example may be combined with aspects of another example to realize yet other examples. Further, each independent feature or component of any given assembly may constitute an additional example.

What is claimed is:

1. A domestic appliance comprising:

a shell;

a door coupled to the shell;

a treatment compartment defined at least in part by the shell and the door;

a panel configured to enclose at least a portion of a cavity below the treatment compartment;

an articulation arrangement coupled to the shell and configured to allow the panel to move from a closed and locked vertical position to an unlocked and open non-vertical position whilst being coupled to the shell;

a locking mechanism configured to selectively lock the panel in the vertical position; and a first pair of pins coupled to the shell on one end of the cavity and a second pair of pins coupled to the shell on an opposite end of the cavity, and the panel includes a first side member configured to engage the first pair of pins and a second side member configured to engage the second pair of pins, the engagement of the pins and the side members enabling the panel to lift in a vertical direction to unlock the panel, and rotate the unlocked panel from the vertical position to allowing access to the cavity.

2. The domestic appliance of claim 1, wherein the locking mechanism is finger or hand operable to place the panel in a locked position or an unlocked position while the panel is in or substantially in the vertical position, and wherein once the locking mechanism is in the unlocked position, the panel is moveable via the articulation arrangement to a horizontal open position allowing access to the cavity.

3. The domestic appliance of claim 1, wherein the articulation arrangement comprises a first linear slot and a second slot including a linear portion and a curved portion extending from one end of the linear portion, the first linear slot engaging a first pin coupled to the shell or panel and the second slot engaging a second pin coupled to the shell or panel, the locking mechanism including the linear portion of the second slot and the second pin.

4. The domestic appliance of claim 1, wherein the locking mechanism comprises either a magnet, a push pin, a latch, or a combination thereof.

5. The domestic appliance of claim 4, wherein the locking mechanism is positioned on the shell or the panel.

6. A domestic appliance comprising:

a housing including a base portion and an opening for accessing a treatment compartment of the housing;

a door movable for at least partially closing the opening;

a panel including a planar surface configured to enclose at least a portion of the base portion in a vertical orientation and expose at least a portion the base portion in a horizontal orientation;

a first side member extending from one end of the panel in a perpendicular direction to the planar surface, and a second side member extending from an opposite end of the panel in the perpendicular direction; and a first pair of pins coupled to the housing on one end of the base portion and a second pair of pins coupled to the housing on an opposite end of the base portion, wherein the first side member is configured to engage the first pair of pins and the second side member is configured to engage the second pair of pins, the engagement of the pins and the side members enabling the panel in the vertical orientation to lift in a vertical direction to unlock the panel, and rotate the unlocked panel from the vertical orientation to at least partially expose the base portion.

7. The domestic appliance of claim 6, further comprising a kick plate fascia coupled to the planar surface of the panel.

8. The domestic appliance of claim 7, wherein the kick plate fascia is configured to slide on the panel and includes a plurality of tabs extending from a rear top flange of the kick plate fascia configured to engage corresponding punch outs in the panel.

9. The domestic appliance of claim 6, wherein each of the first and second side members includes a first slot that is linear and a second slot including a linear portion and a curved portion, the slots of the first side member are configured to engage the first pair of pins and the slots of the second side member are configured to engage the second pair of pins, and the first slots and the linear portions of the second slots are oriented vertically when the panel is in the vertical orientation and are oriented horizontally when the panel is in the horizontal orientation.

10. The domestic appliance of claim 9, wherein one end of the curved portion extends from one end of the linear portion, the first slot engages one of the pins in the pair of pins and the second slot engages another one of pins in the pair of pins.

11. The domestic appliance of claim 9, wherein a size and shape of the first slots is the same as a size and shape of the linear portion of the second slots.

12. The domestic appliance of claim 9, wherein the curved portion extends from one end of the linear portion in a direction away from the planar surface of the panel.

13. The domestic appliance of claim 9, wherein the curved portion is provided along a radius measured from a center of bottom end of the first slot in the vertical orientation.

14. The domestic appliance of claim 9, wherein:

when the panel is in the vertical orientation, a first pin of the first and second pair of pins is positioned on one end of the first slots and a second pin of the first and second pair of pins is positioned on an end of the linear portion of the second slot; and when the panel is in the horizontal orientation, the first pin of the first and second pair of pins is positioned on an opposite end of the first slots and the second pin of the first and second pair of pins is positioned on an end of the curved portion of the second slot.

15. The domestic appliance of claim 9, wherein the engagement between the first slots and the pins in the first slots provides a pivotal movement between the vertical orientation and the horizontal orientation of the panel.

16. The domestic appliance of claim 6, wherein the panel and the first and second side members consists of a single piece of material.

* * * * *